United States Patent [19]

Van Houten

[11] Patent Number: 4,917,572

[45] Date of Patent: Apr. 17, 1990

[54] CENTRIFUGAL BLOWER WITH AXIAL CLEARANCE

[75] Inventor: Robert Van Houten, Winchester, Mass.

[73] Assignee: Airflow Research and Manufacturing Corporation, Watertown, Mass.

[21] Appl. No.: 197,226

[22] Filed: May 23, 1988

[51] Int. Cl.[4] ..... F04D 1/00

[52] U.S. Cl. ..... 415/206; 415/121.2; 415/172.1; 415/174.5

[58] Field of Search ..... 415/203, 206, 121.2, 415/172.1, 174.5

[56] References Cited

U.S. PATENT DOCUMENTS

| | | | |
|---|---|---|---|
| 1,787,656 | 1/1931 | Anderson | 415/DIG. 1 |
| 3,597,117 | 8/1971 | Zochfeld | 417/354 |
| 3,627,440 | 12/1971 | Wood | 415/206 |
| 3,829,250 | 8/1974 | Samson | 415/219 |
| 3,967,874 | 7/1976 | Calabro | 339/112 R |
| 4,086,886 | 5/1978 | Edmainer | 123/41.65 |
| 4,269,571 | 5/1981 | Shikatani | 417/234 |
| 4,432,694 | 2/1984 | Kuroda et al. | 415/170 A |
| 4,526,506 | 7/1985 | Koger | 415/98 |
| 4,549,848 | 10/1985 | Wallman | 415/206 |
| 4,647,271 | 3/1987 | Nagai et al. | 416/186 R |
| 4,662,830 | 5/1987 | Pottebaum | 417/424 |
| 4,781,526 | 11/1988 | Mead | 415/121 G |

FOREIGN PATENT DOCUMENTS

| | | | |
|---|---|---|---|
| 1157902 | 11/1983 | Canada . | |
| 1905269 | 8/1970 | Fed. Rep. of Germany . | |
| 2210271 | 5/1981 | Fed. Rep. of Germany . | |
| 1237797 | 4/1986 | U.S.S.R. | 415/161 |
| 1262122 | 10/1986 | U.S.S.R. | 415/206 |
| 1426503 | 3/1976 | United Kingdom . | |
| 1473919 | 5/1977 | United Kingdom . | |
| 1483455 | 8/1977 | United Kingdom . | |
| 2063365 | 6/1981 | United Kingdom . | |
| 2080879 | 2/1982 | United Kingdom . | |
| 2164494 | 5/1986 | United Kingdom . | |

*Primary Examiner*—Robert E. Garrett
*Assistant Examiner*—John T. Kwon

[57] ABSTRACT

A centrifugal blower with rearwardly curved impeller blades positioned in a housing between two housing faces that are spaced apart along the impeller axis. One of the housing faces defines a housing inlet. The housing is substantially closed off with the exception of the inlet and an outlet. The blower is generally characterized in that the: (a) clearance between the impeller blades and at least one of the housing faces is greater than 30% of the impeller blade depth; (b) the impeller diameter is at least 70% of the housing dimension along that diameter; and (c) area of the blower outlet is greater than 70% of the area of a section of the housing taken perpendicular to the direction of airflow along the impeller axis.

12 Claims, 4 Drawing Sheets

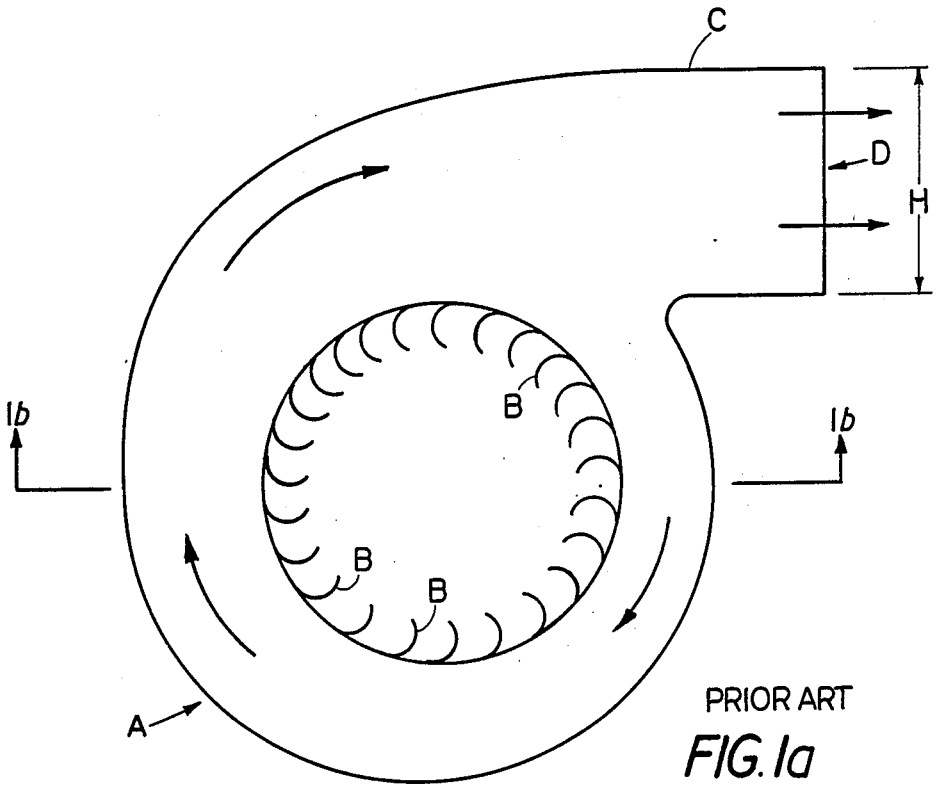
PRIOR ART
FIG. Ia
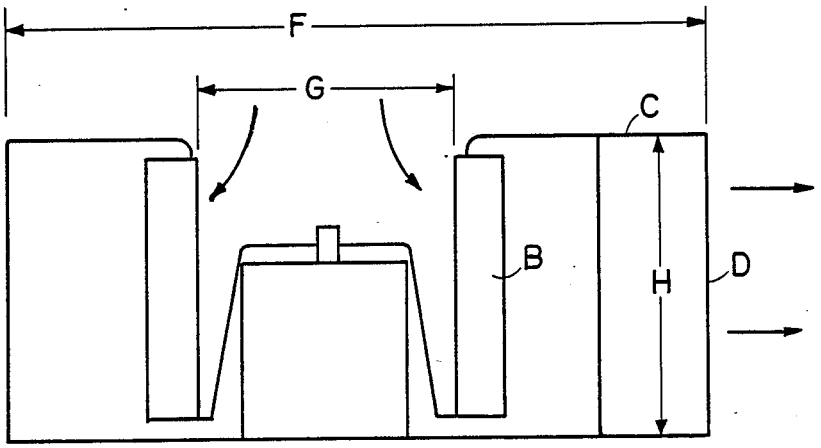
PRIOR ART
FIG. Ib

CENTRIFUGAL BLOWER WITH AXIAL CLEARANCE

BACKGROUND OF THE INVENTION

This invention relates to centrifugal blowers and fans which have a rearwardly curved impeller.

Centrifugal blowers and fans generally include an impeller that rotates in a predetermined direction in a housing, and may be driven by an electric motor. The impeller has curved blades which draw air in axially, along the impeller's axis of rotation, and discharge air radially outwardly. Such blowers are used in a variety of applications, and blower design must account for many factors including the design points for pressure difference and airflow volume, motor power and speed, space constraints, inlet and outlet configuration, noise, and manufacturing tolerances.

One important design feature in a centrifugal fan is the angle of the blade tip relative to a tangent to the tip. This angle ($\theta$ in FIG. 2) is called the "blade exit angle". If the blade exit angle is greater than 90°, the impeller is said to have forwardly curved blades; if the blade exit angle is less than 90°, the impeller is said to have rearwardly curved blades.

In general, forwardly curved blades provide relatively large total pressure differences in comparison to rearwardly curved blades, all other things being equal. However, more of the pressure differential generated by forwardly curved blades is dynamic, rather than static—static pressure being the pressure differential across the impeller, and dynamic pressure being the pressure differential inherent in the kinetic energy of moving fluid. In order to recapture the dynamic pressure, forwardly curved blowers generally include a volute, which adds to the space required by the blower.

FIGS. 1A and 1B are highly diagrammatic representations of one form of conventional forwardly curved centrifugal blower with a volute. In the blower of FIGS. 1A and 1B, a significant percentage of the total pressure differential is dynamic, and a volute C is included to recover that pressure. The airflow at outlet D is uniform, but the overall space required for the blower is high, in that total width F is high relative to inlet diameter G and outlet dimension H.

Often, rearwardly curved blowers can be used without volute, since most of the total pressure difference is static pressure. FIGS. 2A and 2B are highly diagrammatic representatives of one form of conventional rearwardly curved centrifugal blower. In FIGS. 2A and 2B, the backwardly curved blades J of blower provide a relatively high percentage of pressure differential as static pressure rise, and the volute is not so likely to be required. However, airflow at the outlet is not uniform, and the ratio of the inlet dimension M to outlet dimension L is low, which can increase inlet losses.

In some applications, uniformity of discharge velocity over a relatively large area is desirable, for example, when the air is discharged from one side of the blower to a heat exchanger or to a cage of computer cards. In the former case, the pressure drop through the heat exchanger increases if the flow is non-uniform. In the latter case, air flow volume must be designed to accommodate the temperature of the most critical component, and a non-uniform airflow increases the design point for the volume of airflow, all other things being equal.

The above-described rearwardly-curved blade design tends to concentrate airflow along the open side of the impeller, as indicated by the arrows in FIG. 2A.

Specific centrifugal blowers described in prior patents are discussed below.

Koger et al., U.S. Pat No. 4,526,506 and DE 2,210,271disclose rearwardly curved centrifugal blowers with a volute.

GB No. 2,080,879 discloses a rearwardly curved centrifugal blower with stator vanes to convert radial flow to axial flow.

Samson, U.S. Pat. No. 3,829,250 discloses a backward-curved blower wheel in a housing. The blower wheel induces a flow of air in a generally radially outward direction, and the housing extends continuously around the circumference of the wheel to provide a plenum and to direct airflow axially. Airflow discharge is from the face opposite the inlet.

Zochfeld, U.S. Pat. No. 3,597,117 and GB No. 2,063,365disclose forwardly curved centrifugal blowers with a volute.

Calabro, U.S. Pat. No. 3,967,874 discloses a blower 16 positioned in a plenum chamber 14. The blade configuration and blower design are not apparent, but opening 46 in the bottom of the plenum chamber is in communication with the blower outlet.

GB No. 2,166,494 discloses a centrifugal impeller in a rotationally symmetrical cone-shaped housing, with guide vanes to produce an axial discharge.

GB No. 1,483,455 and GB No. 1,473,919 disclose centrifugal blowers with a volute.

GB No. 1,426,503 discloses a centrifugal blower with dual openings

Shikatani et al., U.S. Pat. No. 4,269,571 disclose a centripetal blower, which draws air in axial entrance 26 and out of the top periphery of disc 22 and axial exit 27 (3:26–36).

Canadian No. 1,157,902 discloses a rearwardly curved centrifugal blower with a curved sheet-metal guide.

Edmainer et al., U.S. Pat. No. 4,086,886 discloses a radial blower for a radiator block. A bladeless annular space 18 is provided between the blower rotor 12 and the radiator block 11.

Pottebaum, U.S. Pat. No. 4,662,830 discloses a centrifugal fan which draws air across a circuit board.

SUMMARY OF THE INVENTION

The invention generally features a rearwardly curved centrifugal blower that is compact, and that provides a uniform airflow discharge. The impeller is positioned between two housing faces that intersect, and are spaced apart along, the impeller axis; one of those housing faces defines a housing inlet. The housing substantially closes off the space between these faces on all sides except for a discharge side defining the blower outlet. The blower is generally characterized in that:

(a) an airflow channel exists as a result of the clearance between the impeller blades and at least one of the two housing faces; that clearance is greater than 30% of the impeller blade profile or depth, i.e., the depth of the blade at the discharge (radially outermost) portion of the blade;

(b) the impeller diameter is at least 70% of the housing dimension along that diameter.

(c) the area of the blower outlet is greater than 70% of the area of a section of the housing taken along the impeller axis perpendicular to the direction of airflow discharge.

The preferred housing design is a rectangular solid, in which the housing faces are generally perpendicular to the impeller axis, and discharge is solely through a discharge face generally parallel to that axis. The impeller blade profile is at least 30% of the axial spacing between the housing faces. Since the pressure differential is primarily static, the central inlet of the impeller is fitted with respect to the housing inlet to avoid recirculation of air from the high pressure side of the impeller, e.g. by means of a labyrinth seal or by controlling running clearances. At least one of the inlet and the outlet are covered by a protective screen. The clearance between the impeller and the housing face opposite the inlet is greater than 30% of the impeller depth, so an air channel is established, and the motor can be positioned in that channel.

The impeller draws air in the inlet in a generally axial direction and forces the air radially outward. Roughly one-half the air then passes between the impeller and the housing face having the greatest clearance, to the outlet. The presence of that air channel allows the use of a larger diameter fan and a bigger inlet for a given size of housing, thereby allowing movement of a larger volume of air. The design also allows a smaller blade angle $\theta$, all other things being equal, and it permits a more efficient fan without the use of a volute. For all of these reasons, the fan design is compact and efficient. Moreover, the discharge velocity is uniform across the outlet, making the blower particularly suitable for mounting adjacent to a heat exchanger or for cooling electronic and electrical components.

Other features and advantages of the invention will be apparent from the following description of the preferred embodiment and from the claims.

BRIEF DESCRIPTION OF THE FIGURES

FIG. 1*a* is a highly diagrammatic representation of a prior art forwardly curved centrifugal flower.

FIG. 1*b* is a sectional view of the blower of FIG. 1*a* along 1*b*—1*b*.

DESCRIPTION OF THE PREFERRED EMBODIMENT Structure

Figure 2A:
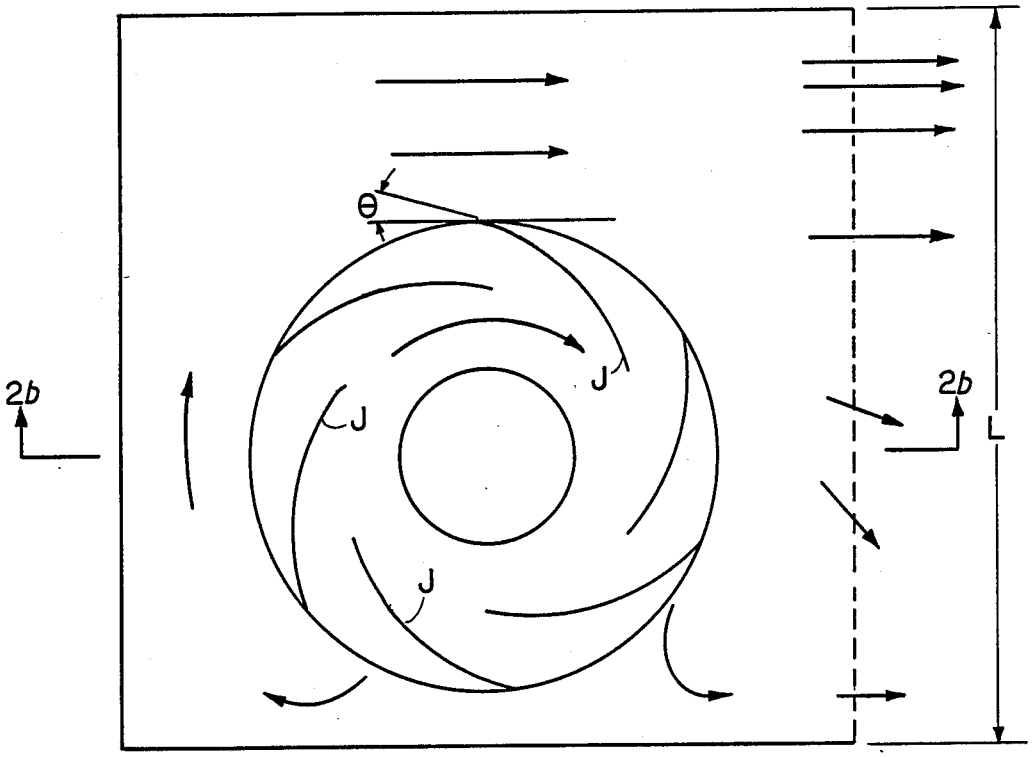
PRIOR ART FIG. 2a
FIG. 2 is a highly diagrammatic representation of a prior art rearwardly curved centrifugal blower.
FIG. 2*b* is a sectional view of the blower of FIG. 2*a* along 2*b*—2*b*.
Figure 2B:
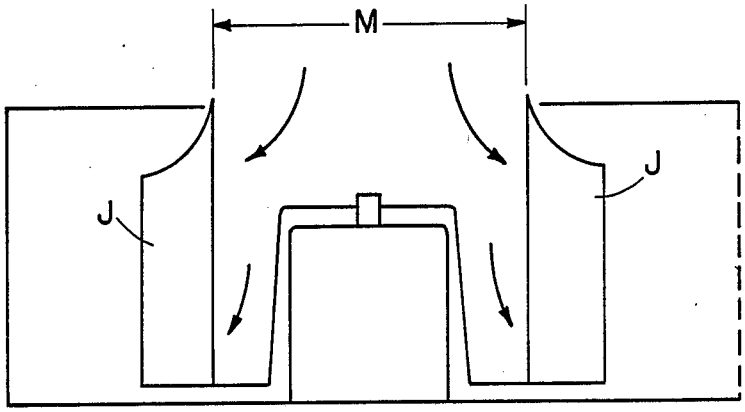
PRIOR ART FIG. 2b
Figure 3A:
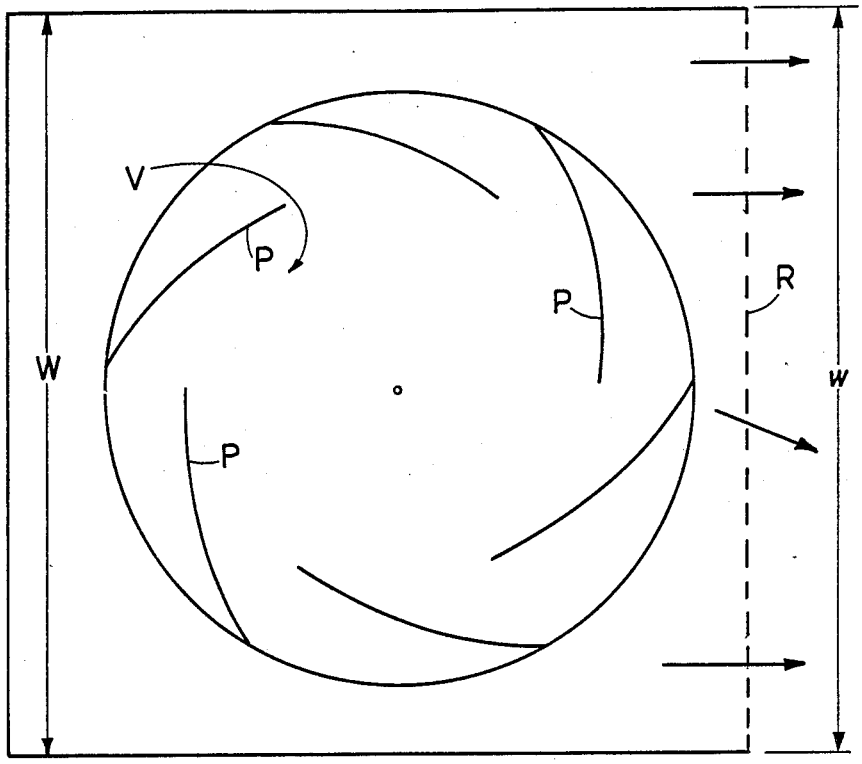
FIGS. 3*a* and 3*b* are highly diagrammatic representations of a blower according to the invention.
Figure 3B:
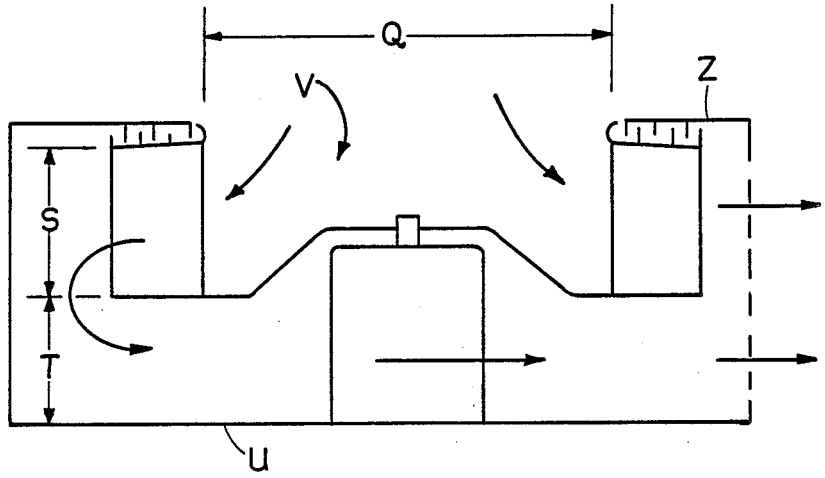

FIGS. 3*a* and 3*b* are highly diagrammatic representations showing airflow in a backwardly curved centrifugal blower according to the invention. Blades P draw air through inlet V in face Z and force it outward through outlet R. The blade depth S is controlled relative to clearance T, to allow airflow between the blades and housing wall U to outlet R. Outlet R provides relatively uniform airflow across a wide dimension relative to overall housing width W. Inlet dimension Q is also wide relative to width W.

Figure 4:
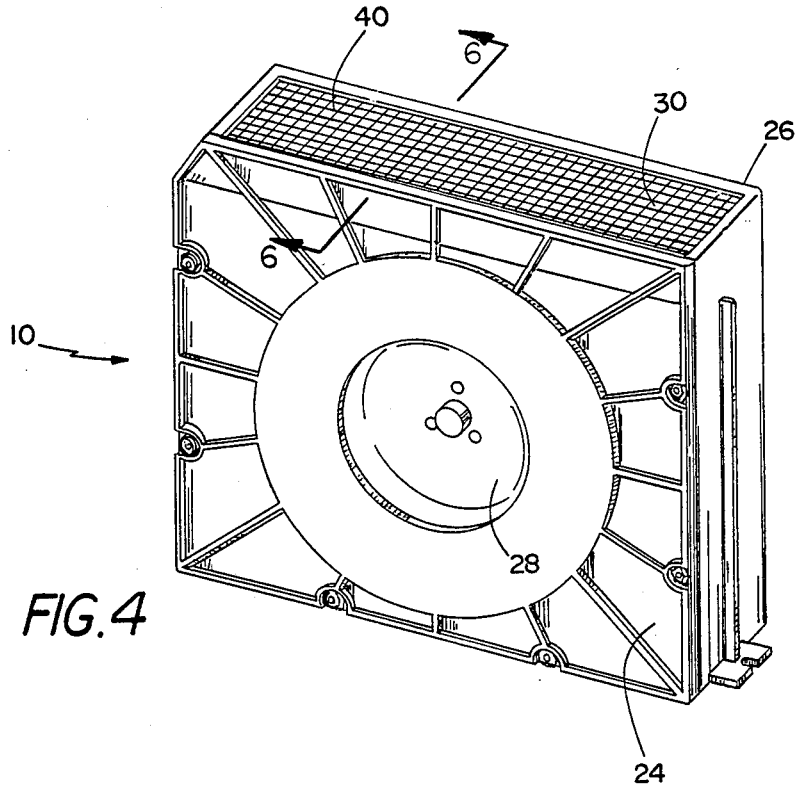
FIG. 4 is a perspective view of a centrifugal blower according to the invention.
Figure 5:
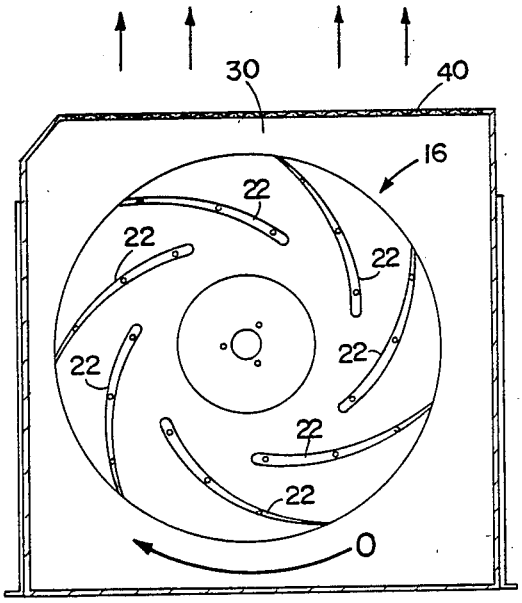
FIG. 5 is top view of the blower of FIG. 4, with the top face and the top plate of the impeller removed.
Figure 6:
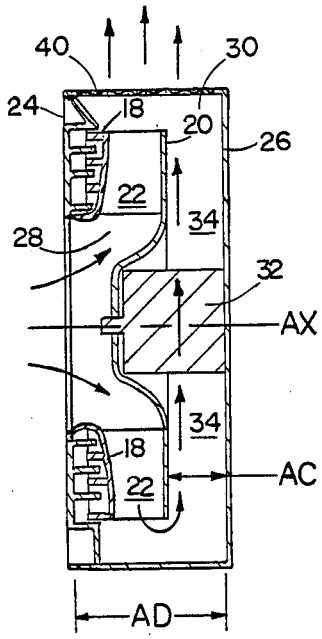
FIG. 6 is a sectional view of the blower along 6—6 of FIG. 4.

In more specific detail, FIGS. 4–6 show blower 10 which can be fixed by conventional means to blow air through cards of a computer containing electronic components, with a relatively uniform airflow velocity.

In FIGS. 4–6, the housing of blower 10 is generally shaped as a rectangular solid. Impeller 16 is positioned within the housing. Impeller 16 includes a top plate 18 and a bottom plate 20 securing multiple e.g. seven) rearwardly curved blades 22, rotating in direction 0 on axis AX. Air is drawn from inlet 28 and discharged through outlet 30. Housing 14 has two radially extending walls 24 and 26 which are parallel to each other and perpendicular to axis AX. Walls 24 and 26 are spaced apart not only to accommodate the depth of blades 22, but also to provide an airflow channel 34 between blades 22 and wall 26.

Top plate 18 has very carefully controlled clearance with radial wall 24, and a conventional labyrinth seal limits recirculation from the interior of the housing to inlet 28.

Bottom plate 20 is provided considerable clearance from wall 26 to create airflow channel 34. Specifically, the axial dimension AC of channel 34 is at least 30%, preferably at least 50%, and most preferably at least 65% of the blade depth (the distance between plates 18 and 20). Dimension AC can be equal to or even greater than the blade depth; however, for compactness, it is preferable that the blade depth be at least 30% of the entire housing depth AD (i.e., the spacing between radial walls 24 and 26).

The blades 22 have a diameter which is greater than 70%, in this case about 80%, of the housing dimension so that the clearance on each side of the blade is about 12.5% of the blade diameter. In this way, the overall size of the blower is controlled to improve packaging.

Electric motor 32 is positioned within the housing, in channel 34, providing two benefits: (a) the motor 32 is cooled by airflow in the channel; and (b) the package is relatively compact (motor 32 does not extend outside the package, without sacrificing inlet area, as may occur when the motor is positioned in the inlet.

Outlet 30 covers substantially all of discharge face of the housing, and the housing provides substantially no other outlets. Outlet 30 may include a protective screen 40 or structural members, but there is no intentional blockage of a portion of the outlet, e.g. so as to provide direction to the exit flow, using a crude volute. Thus a substantial (at least 70%) portion of the discharge face is open, or has uniform openness (e.g. it is open, but for a screen or regularly placed structural members.)

Operations

As motor 32 rotates in direction 0, impeller 16, air is drawn through inlet 28 and is forced radially outward. Approximately half the air is discharged directly through outlet 30, and half moves along channel 34 to outlet 30, as indicated by the arrows in FIGS. 3A and 3B. The airflow at outlet 30 cools computer components, and efficiency is improved by the uniformity in that airflow. As a result, the design pressure required is reduced.

Manufacture

Blower 10 can be injection molded from a resin, e.g. Lexan 500 (General Electric) by techniques well known to those in the field. Assembly (e.g. by ultrasonic welding) is also accomplished by well known techniques.

OTHER EMBODIMENTS

Other embodiments are within the following claims.

For example, the clearance between the inlet face and the blade tips can be substantially increased, providing meaningful airflow on both sides of the impeller. In this case, the size of the airflow channel (channel 34 in FIG. 6) opposite the inlet side of the impeller can be reduced. In any event, the channel generally should be greater than 30% of the blade depth, as described above.

I claim:

1. A centrifugal blower comprising an impeller mounted to rotate on an axis in a predetermined direction, and a housing having two housing faces spaced apart along that axis, the impeller having blades that are curved rearwardly away from that rotational direction, the blades being positioned within the housing between the housing faces, one of the housing faces defining an inlet, the housing being substantially closed except for said inlet and an outlet, the blower being characterized in that the:

(a) clearance between the impeller blades and at least one of the housing faces is greater than 30% of the impeller blade depth, whereby an air channel is established by said clearance;

(b) the impeller diameter is at least 70% of the housing dimension along that diameter;

(c) the cross-sectional area of the blower outlet is greater than 70% of the area of the cross-sectioned area of the housing taken in a plane that is perpendicular to the direction of airflow and along the impeller axis.

2. The blower of claim 1 wherein said housing faces are generally parallel to each other and generally perpendicular to the axis.

3. The blower of claim 1 or claim 2 wherein the outlet is through a face that is generally parallel to the impeller axis.

4. The blower of claim 3 wherein the housing is a rectangular solid.

5. The blower of claim 1 wherein the impeller comprises a central inlet, positioned and sized with respect to the housing inlet to avoid recirculation of air from the high pressure side of the impeller to the housing inlet.

6. The blower of claim 5 wherein the housing inlet and the impeller inlet form a labyrinth seal.

7. The blower of claim 5 wherein the housing inlet and the impeller inlet are positioned with running clearances selected to avoid recirculation.

8. The blower of claim 1 wherein the impeller blade depth is at least 30% of the axial spacing between the housing faces.

9. The blower of claim 1 wherein the impeller is mounted on an electric motor enclosed in the housing, and exposed to airflow in said channel.

10. The blower of claim 1 wherein at least one of the inlet and the outlet are covered by a protective screen.

11. A centrifugal blower comprising an impeller mounted to rotate on an axis in a predetermined direction, and a housing having two housing faces spaced apart along that axis, the impeller having blades that are curved rearwardly away from that rotational direction, the blades being positioned within the housing between the housing faces, one of the housing faces defining an inlet, the housing being substantially closed except for said inlet and an outlet, the blower being characterized in that the:

(a) clearance between the impeller blades and the housing face opposite said inlet is greater than 30% of the impeller blade depth, whereby an air channel is established by said clearance;

(b) the impeller diameter is at least 70% of the housing dimension along that diameter;

(c) the cross-sectional area of the blower outlet is greater than 70% of the area of the cross-sectioned area of the housing taken in a plane that is perpendicular to the direction of airflow and along the impeller axis.

12. The blower of claim 11 wherein the impeller is mounted on a motor enclosed in the housing and exposed to airflow in said channel.

* * * * *